US007621204B2

(12) United States Patent
Merhar, III et al.

(10) Patent No.: US 7,621,204 B2
(45) Date of Patent: Nov. 24, 2009

(54) RIVING KNIFE SYSTEM FOR TABLE SAW

(75) Inventors: Carl F. Merhar, III, Jackson, TN (US); Yung Ho Chang, Ta Li (TW)

(73) Assignee: Black & Decker Inc., Newark, DE (US)

( * ) Notice: Subject to any disclaimer, the term of this patent is extended or adjusted under 35 U.S.C. 154(b) by 170 days.

(21) Appl. No.: 11/775,500

(22) Filed: Jul. 10, 2007

(65) Prior Publication Data

US 2008/0022820 A1 Jan. 31, 2008

(51) Int. Cl.
*B27G 19/08* (2006.01)

(52) U.S. Cl. ..... 83/13; 83/102.1; 83/477.2

(58) Field of Classification Search ..... 83/102.1, 83/477.2, 440.2, 478, 13
See application file for complete search history.

(56) References Cited

U.S. PATENT DOCUMENTS 6,840,144 B2 * 1/2005 Huang ..... 83/102.1
7,137,327 B2 * 11/2006 Garcia et al. ..... 83/102.1
7,437,981 B2 * 10/2008 Burke et al. ..... 83/102.1
2005/0211034 A1 * 9/2005 Sasaki et al. ..... 83/102.1

FOREIGN PATENT DOCUMENTS

EP 1658944 * 5/2006
JP 2005 262337 A 9/2005
WO WO 2004/041490 A2 5/2004

OTHER PUBLICATIONS

Ulrich Frisch, European Search Report, Oct. 31, 2007, Munich, Germany.
Annex to the European Search Report on European Patent Application No. EP 07 11 2928.

* cited by examiner

*Primary Examiner*—Stephen Choi
(74) *Attorney, Agent, or Firm*—Adan Ayala

(57) ABSTRACT

A table saw including a base assembly, a table assembly supported by the base assembly, a saw assembly connected to at least one of the base assembly and the table assembly, a riving knife assembly connected to the saw assembly, the riving knife assembly comprising a holder, a plate attached to the holder, a riving knife disposed between the holder and the plate, and a retainer disposed within the holder and contacting the riving knife. The retainer may be biased towards the riving knife.

2 Claims, 2 Drawing Sheets

RIVING KNIFE SYSTEM FOR TABLE SAW

FIELD

This specification relates to table saws and more specifically to riving knife systems for table saws.

BACKGROUND

It is well known in the table saw field to provide a riving knife assembly behind the table saw blade. Typically the riving knife assembly is difficult to remove from the table saw. Accordingly, it is an object of the invention to provide an enhanced riving knife assembly.

SUMMARY

A table saw including a base assembly, a table assembly supported by the base assembly, a saw assembly connected to at least one of the base assembly and the table assembly, a riving knife assembly connected to the saw assembly, the riving knife assembly comprising a holder, a plate attached to the holder, a riving knife disposed between the holder and the plate, and a retainer disposed within the holder and contacting the riving knife. The retainer may be biased towards the riving knife.

Additional features and benefits of the present invention are described, and will be apparent from, the accompanying drawings and the detailed description below.

BRIEF DESCRIPTION OF THE FIGURES

The accompanying drawings illustrate preferred embodiments according to the practical application of the principles thereof, and in which:

FIG. 3 illustrates the riving knife assembly of FIG. 2, where

FIG. 4 illustrates the riving knife assembly of FIG. 2, where

DETAILED DESCRIPTION

The present invention will now be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
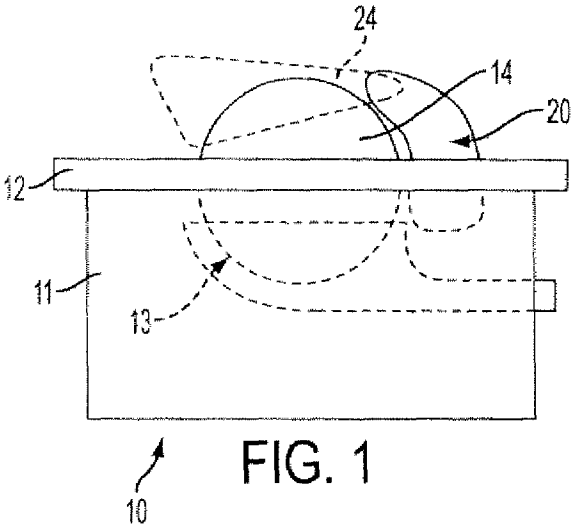
FIG. 1 is an exemplary table saw incorporating the invention.
Figure 2:
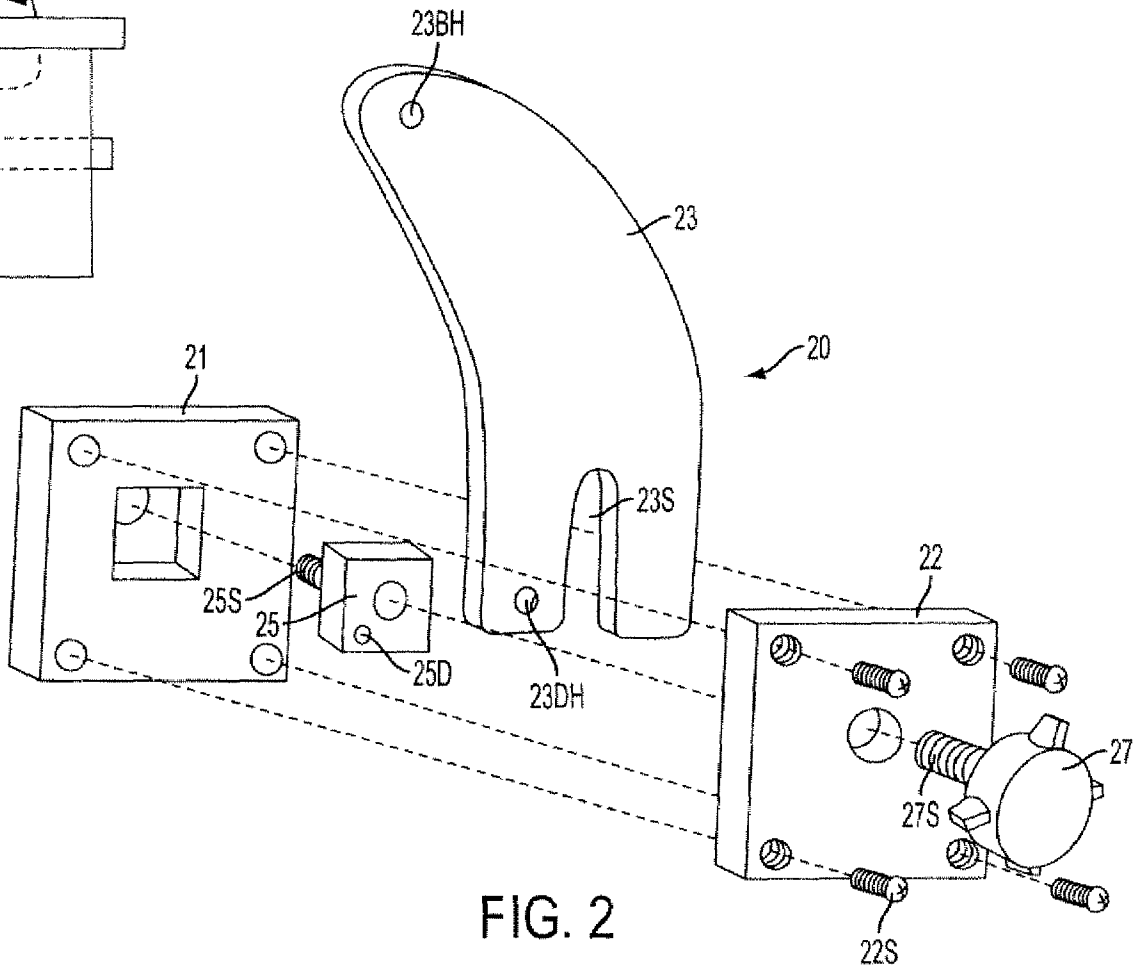
FIG. 2 is an exploded perspective of an exemplary riving knife assembly according to the invention.

Referring to FIG. 1, a table saw 10 preferably includes a base assembly 11 that supports a table assembly 12. A saw assembly 13 is pivotably connected to the base assembly 11 and/or the table assembly 12. Examples of the saw assembly 13 can be found in U.S. Pat. Nos. 6,009,782 and 7,036,414, which are hereby fully incorporated herein by reference.

Saw assembly 13 may include a blade 14 driven by a motor (not shown).

Referring to FIGS. 1-4, a riving knife assembly 20 may be attached to the saw assembly 13. In particular, riving knife assembly 20 may include a holder 21 attached to the saw assembly 13, and a plate 22 attached to holder 21. Preferably, plate 22 is attached to holder 21 via screws 22S.

Riving knife assembly 20 preferably has a riving knife 23 with a curved blade edge which will be placed adjacent to blade 14. Riving knife 23 may be disposed between holder 21 and plate 22.

A retainer 25 may be disposed between holder 21. Such retainer 25 may have a screw 25S extending through holder 21 and captured by a washer 25W and nut 25N to prevent retainer 25 from being separated from holder 21. A spring 26 may be disposed between holder 21 and retainer 25 for biasing retainer 25 towards plate 22.

Retainer 25 may have a protrusion 25D that engages a depression, notch or hole 23DH in riving knife 23. Persons skilled in the art will recognize that protrusion 25D is effectively biased into such hole 23DH by spring 26.

Figure 3B:
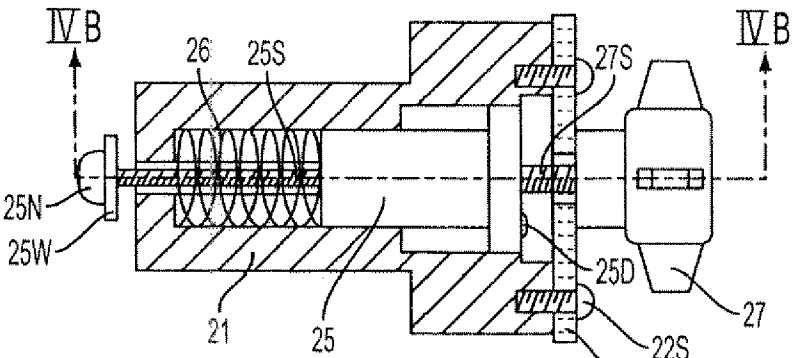
FIGS. 3A-3B are partial cross-sectional views along lines IIIA-IIIA and IIIB-IIIB of FIGS. 4A-4B, respectively.
Figure 4B:
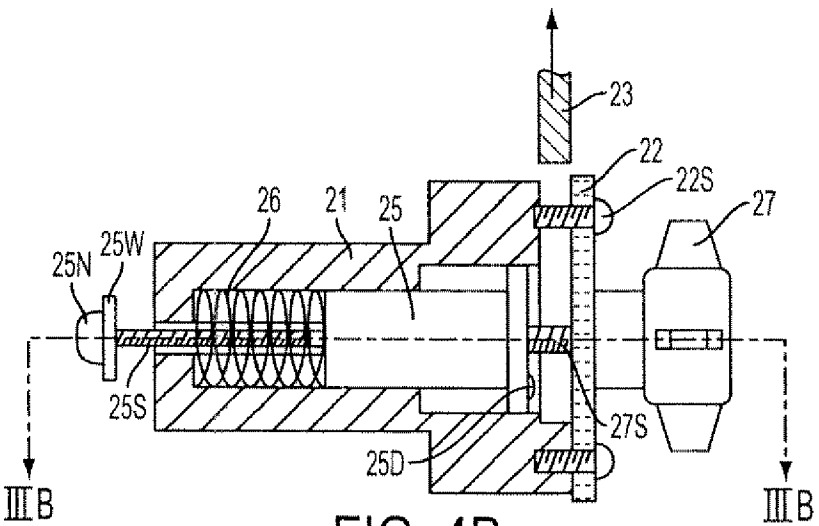
FIGS. 4A-4B are partial cross-sectional views along lines IVA-IVA and IVB-IVB of FIGS. 3A-3B, respectively.
Figure 3A:
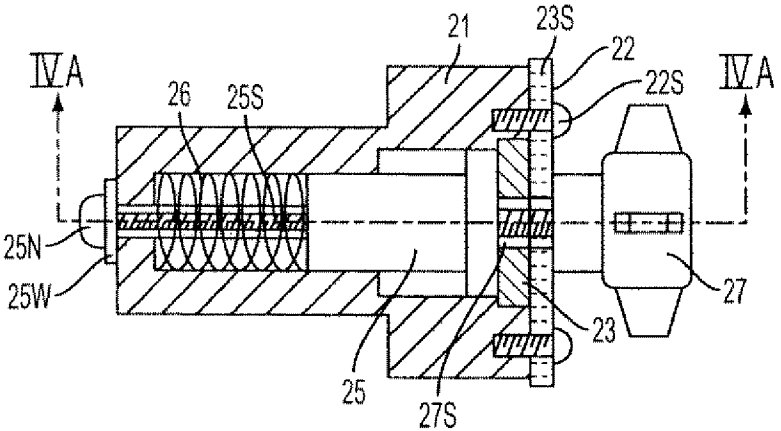
Figure 4A:
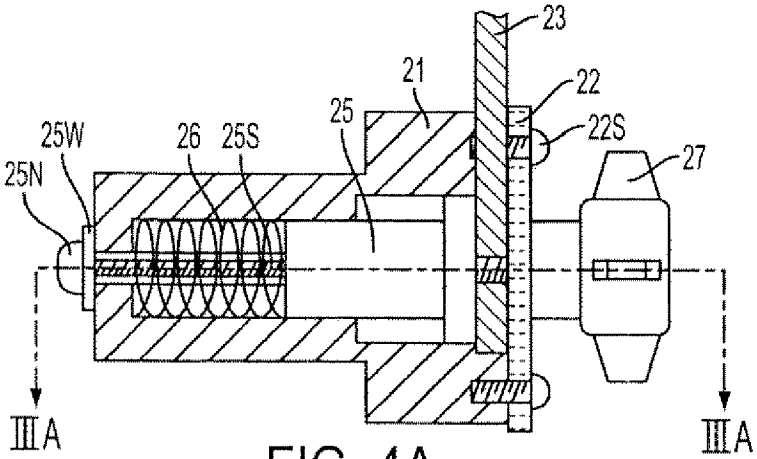

In order to lock the riving knife 23 within holder 21 and plate 22, it is preferable to provide a knob 27 that has a screw 27S extending through plate 22 and riving knife 23 and threadingly engages retainer 25. Persons skilled in the art will recognize that the same result will be achieved by providing an alternative screw on retainer 25 extending through plate 22 and riving knife 23 and threadingly engaging knob 27. With either arrangement, when the user rotates knob 27, riving knife will be lockingly sandwiched between retainer 25, plate 22 and knob 27, as shown in FIGS. 3A and 4A.

In order to remove riving knife 23 from holder 21 and plate 22, the user would loosen knob 27 and push knob 27 towards holder 21. This moves retainer 25 away from plate 22 and riving knife 23, disengaging protrusion 25D from hole 23DH, allowing the user to pull out riving knife 23 from holder 21 and plate 22, as shown in FIGS. 3B and 4B.

Persons skilled in the art will recognize that it is preferable to provide riving knife 23 with a slot 23S that allows screw 27S to extend therethrough and yet allow removal of riving knife 23 without having to remove screw 27S.

Persons skilled in the art will recognize that it may be advantageous to provide a blade guard assembly 24 that can be installed unto riving knife 23, as is well known in the art. Referring to FIG. 1, blade guard assembly 24 may have a thumbscrew (not shown) that can be inserted through hole 23BH on riving knife 23 for securing the blade guard assembly 24 unto riving knife 23.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A table saw comprising:

a base assembly;

a table assembly supported by the base assembly;

a saw assembly connected to at least one of the base assembly and the table assembly;

a riving knife assembly connected to the saw assembly, the riving knife assembly comprising:

a holder, a plate attached to the holder, a riving knife disposed between the holder and the plate, a retainer disposed within the holder and contacting the riving knife, the retainer being disposed on a side of the riving knife and having a protrusion engaging a notch in the riving knife, a spring disposed between the retainer and the holder, the spring biasing the retainer towards the riving knife, and a knob disposed on an other side of the riving knife, the knob extending through the plate and riving knife, the knob threadingly engaging the retainer so that, upon rotation of the knob, the retainer is drawn into locking contact with the riving knife.

2. A method for using a table saw having a base assembly, a table assembly supported by the base assembly, a saw assembly connected to at least one of the base assembly and the table assembly, a riving knife assembly connected to the saw assembly, the riving knife assembly comprising a holder, a plate attached to the holder, a riving knife disposed between the holder and the plate, and a retainer disposed within the holder and contacting the riving knife, the retainer being disposed on a side of the riving knife and having a protrusion engaging a notch in the riving knife, a spring disposed between the retainer and the holder, the spring biasing the retainer towards the riving knife, and a knob disposed on an other side of the riving knife, the knob extending through the plate and riving knife, the knob threadingly engaging the retainer, comprising the steps of (performed in the following order):

pushing the knob towards the riving knife;

inserting the riving knife between the holder and the plate;

releasing the knob;

rotating the knob to lock the riving knife in between the holder and the plate;

performing a cutting operation;

pushing the knob towards the riving knife; and pulling the riving knife from the holder.

* * * * *